US005437263A

United States Patent [19]

Ellingham et al.

[11] Patent Number: 5,437,263

[45] Date of Patent: Aug. 1, 1995

[54] HIGH EFFICIENCY FURNACE METHOD AND APPARATUS

[75] Inventors: Jeffrey R. Ellingham, Conroe; Gary W. Bonorden; Mark A. Vackar, both of Houston, all of Tex.

[73] Assignee: Goodman Manufacturing Company, Houston, Tex.

[21] Appl. No.: 113,591

[22] Filed: Aug. 27, 1993

[51] Int. Cl.[6] ..... F24H 3/02

[52] U.S. Cl. ..... 126/110 R; 126/110 AA

[58] Field of Search ..... 126/116 R, 110 R, 110 AA

[56] References Cited

U.S. PATENT DOCUMENTS

| | | | |
|---|---|---|---|
| 4,478,206 | 10/1984 | Ahn | 126/99 A |
| 4,603,680 | 8/1986 | Dempsey et al. | 126/99 A |
| 4,603,681 | 8/1986 | Clawson | 126/110 R |
| 4,729,207 | 3/1988 | Dempsey et al. | 126/112 |
| 4,738,307 | 4/1988 | Bentley | 165/133 |
| 4,807,588 | 2/1989 | Bentley et al. | 126/110 R |
| 4,848,314 | 7/1989 | Bentley | 126/116 R |
| 4,960,102 | 10/1990 | Shellenberger | 126/110 R |
| 4,974,579 | 12/1990 | Shellenberger et al. | 126/110 R |
| 5,060,722 | 10/1991 | Zdenek et al. | 165/170 |
| 5,097,819 | 3/1992 | Talbert et al. | 126/110 R |
| 5,178,124 | 1/1993 | Lu et al. | 126/116 R |
| 5,368,010 | 11/1994 | Weber et al. | 126/116 R |

OTHER PUBLICATIONS

"Product Data: 58MYA, Deluxe Multipurpose Fixed Capacity Gas Furnace"; Carrier Heating and Cooling (No Date).

"The Dependable 92 Ultra High Efficiency Gas Furnace" Jun. 1990, Goodman Manufacturing Corporation.

*Primary Examiner*—Carroll B. Dority

*Attorney, Agent, or Firm*—Ben D. Tobor

[57] ABSTRACT

An upflow/downflow high efficiency furnace includes a means for mounting a secondary heat exchanger by use of a hinge member, which permits the furnace to be installed in either an upflow or downflow mode of operation, without any modification to the furnace as manufactured.

31 Claims, 6 Drawing Sheets

94
92
90
97
176
4
100
147
102
93
80
96
4
82
130
85
122
81
95
140
103

80
90
97
176
150
140
142
151
102
152
121
121
96
82
130
122
85
81
93
103
95
140
141
144
145
146
145
147
100

HIGH EFFICIENCY FURNACE METHOD AND APPARATUS

BACKGROUND OF THE INVENTION

1. Field of the Invention

The invention relates to an upflow/downflow high efficiency furnace for providing heated air to a confined space; and a method for mounting a secondary heat exchanger in a furnace, to permit the furnace to be installed for either an updraft or downdraft mode of operation.

2. Description of the Prior Art

Due to the cost and shortage of natural gas, attempts have been made to design and construct more efficient natural gas-fired hot air furnaces. One method for maximizing the heat energy transferred from the heating fluid, or combustion gases, to the air to be heated, or the air in the enclosure or space to be heated, is to transfer as much latent heat as possible from the water vapor in the heating fluid, or combustion gases, to the air to be heated. Thus, increases in furnace heating efficiency have been accomplished by cooling the flue combustion gases of the heating fluid, while still within the furnace, to below the dew point to recover some of the latent heat of vaporization as usable energy. This is generally accomplished by adding a secondary condensing heat exchanger to the primary heat exchanger, and passing air to be heated initially over the condensing secondary heat exchanger, and then over the primary heat exchanger. Depending on the type of condensing furnace, efficiencies can be in the low to mid 90% range.

In such prior art furnaces, a major disadvantage is that a single furnace design may not be utilized for both updraft and downdraft modes of operation for the furnace. An updraft furnace is a furnace wherein a blower, adapted to blow air over the primary and secondary heat exchangers, is disposed beneath the primary and secondary heat exchangers, and blows the air upwardly over the heat exchangers. A downdraft furnace is one wherein the blower is mounted above the primary and secondary heat exchangers, and blows air downwardly over the heat exchangers. Prior art furnaces are designed only for operation in either an upflow or downflow mode, whereby a heating contractor would have to maintain two different models of furnaces in his or her inventory, in order to be able to install both upflow and downflow furnaces. From a manufacturing standpoint, it is also necessary to have two differently designed furnaces, having different parts therein, in order to supply customer needs for both upflow and downflow furnaces. Accordingly, manufacturing, storage, and inventory costs are increased in order to provide both types of furnaces.

Another disadvantage associated with high efficiency furnaces utilizing a secondary, or condensing, heat exchanger is that because of the temperature of the combustion gas being lowered within the secondary heat exchanger to a temperature below its dew point, the water vapor in the combustion gas condenses and moisture can form in the secondary heat exchanger. The moisture, in combination with other byproducts found in the combustion gases, can be quite corrosive and can freeze, whereby it is necessary to ensure that the moisture and combustion by-products, or collectively "condensation", do not collect and remain in an appreciable amount within the secondary heat exchanger. Should such moisture and combustion gas by-products, or condensation, not be removed from the secondary heat exchanger, they can corrode the metal surfaces of the secondary heat exchanger, or block the fluid passageways through the secondary heat exchanger. This could create a leak path for the combustion gases, which can present a serious health hazard, should such combustion gases leak into the space, or room, being heated or cause a pressure build-up which would turn off the furnace. If the secondary heat exchanger is disposed above the primary heat exchanger, such condensation if it passes downwardly into the primary heat exchanger could also cause damage to the primary heat exchanger and perhaps cause its premature failure. Accordingly, prior art high efficiency furnaces typically require many extra components in order to provide for the removal of the moisture and combustion gas by-products or condensation, from the secondary heat exchanger. These additional parts increase the cost of manufacturing of the furnace.

Accordingly, prior to the development of the present invention, there has been no high efficiency furnace which: can be installed for either an upflow or downflow mode of operation; is easily, efficiently, and economically manufactured; and efficiently prevents moisture and combustion gas by-product remaining in the secondary heat exchanger and blocking the passage of combustion gases through the secondary heat exchanger. Therefore, the art has sought a high efficiency gas furnace which: can be installed for either an updraft or downdraft mode of operation; is easily, efficiently, and economically manufactured; and prevents moisture and combustion gas by-products remaining in the secondary heat exchanger and blocking the passage of combustion gases therethrough, or prevents such moisture and combustion gas by-products flowing back into the primary heat exchanger.

SUMMARY OF THE INVENTION

In accordance with the present invention, the foregoing advantages have been achieved through the present upflow/downflow high efficiency furnace. The present invention includes: a housing; a primary heat exchanger having an inlet and an outlet end; a secondary heat exchanger having first and second ends and an inlet and an outlet, the inlet being disposed in fluid communication with the outlet end of the primary heat exchanger; a burner assembly, for producing combustion gases, disposed adjacent the inlet end of the primary heat exchanger, whereby the combustion gases may flow into the inlet end of the primary heat exchanger; a blower, adapted to blow air over the primary and secondary heat exchangers; a venter blower in fluid communication with the outlet of the secondary heat exchanger and adapted to draw the combustion gases through the primary and secondary heat exchangers and discharge the combustion gases outwardly from the housing; and means for mounting the secondary heat exchanger within the housing with both the inlet and the outlet of the secondary heat exchanger being disposed adjacent the venter blower, the first end of the secondary heat exchanger being disposed adjacent the venter blower, with the secondary heat exchanger sloping downwardly from its first end toward its second end, whereby upon the cooling of the combustion gases in the secondary heat exchanger forming condensation, the condensation will initially flow downwardly within the secondary heat exchanger from its first end to its second end.

Another feature of the present invention is that the secondary heat exchanger may be a finned coil heat exchanger having a plurality of tubes supported by a plurality of transverse vertical fins. Another feature of the present invention is that the finned coil heat exchanger may have a first set of tubes, having first and second ends, the first ends of the first set of tubes being disposed in fluid communication with the outlet end of the primary heat exchanger; and a second set of tubes, having first and second ends, the first ends of the second set of tubes being disposed in fluid communication with the venter blower. A further feature of the present invention is that the first and second sets of tubes may be disposed substantially parallel to each other, and the second ends of the first and second sets of tubes may be in fluid communication with each other at the second end of the secondary heat exchanger. Another feature of the present invention is that the second end of the secondary heat exchanger may be sealed by an end cap member having an inner wall surface which is curved.

An additional feature of the present invention is that a means for diverting the flow of combustion gases from the outlet end of the primary heat exchanger into the first set of tubes of the secondary heat exchanger may be provided. Another feature of the present invention is that the means for diverting the flow of combustion gases may include a collector box which defines an enclosure, having an interior space, in fluid communication with the outlet end of the primary heat exchanger, the outlet and inlet of the secondary heat exchanger, and the venter blower. A further feature of the present invention is that the collector box may include a diverter member which separates the interior space of the enclosure into first and second compartments, the first compartment being in fluid communication between the outlet end of the primary heat exchanger and the first set of tubes of the secondary heat exchanger, and the second compartment may be in fluid communication between the venter blower and the second set of tubes of the secondary heat exchanger.

An additional feature of the present invention is that the means for mounting the secondary heat exchanger within the housing may include a hinge member which permits the secondary heat exchanger to slope downwardly from its first end toward its second end. The hinge member may be formed of a layer of a flexible, compressible material disposed between the first end of the secondary heat exchanger and the venter blower.

In accordance with another aspect of the present invention, the foregoing advantages have also been achieved through the present collector box, for use in a furnace having a primary heat exchanger, a secondary heat exchanger, a venter blower, and combustion gases flowing therethrough. This aspect of the present invention includes: an enclosure formed by a plurality of walls and defining an interior space; an opening in one of the walls adapted for fluid communication with the venter blower; a diverter member disposed within the enclosure, the diverter member separating the interior space into first and second compartments, the first compartment being in fluid communication between the primary and secondary heat exchanger, and the second compartment being in fluid communication between the opening and the secondary heat exchanger; and the diverter member diverts the flow of combustion gases from the primary heat exchanger and the first compartment into the secondary heat exchanger and into the second compartment.

Another feature of this aspect of the present invention is that the secondary heat exchanger has a longitudinal axis and the diverter member is disposed within the enclosure at an acute angle with respect to the longitudinal axis of the secondary heat exchanger.

In accordance with another aspect of the present invention, the foregoing advantages have been achieved through the present finned coil secondary heat exchanger for use in a furnace having a primary heat exchanger and a venter blower with combustion gases flowing therethrough. This aspect of the present invention includes: a first set of tubes, having first and second ends, the first ends of the first set of tubes adapted to be disposed in fluid communication with the primary heat exchanger; a second set of tubes, having first and second ends, the first ends of the second set of tubes adapted to be disposed in fluid communication with the venter blower; the first ends of the first set of tubes being disposed adjacent the first ends of the second set of tubes; and the first and second sets of tubes being disposed substantially parallel with each other.

Another feature of this aspect of the present invention is that the secondary heat exchanger may include means for mounting the secondary heat exchanger in the furnace in first and second sloping positions: the first sloping position, having the first and second sets of tubes sloping downwardly from the first ends of the first and second sets of tubes to the second ends of the first and second sets of tubes toward the primary heat exchanger when the primary heat exchanger is disposed beneath the secondary heat exchanger; and the second sloping position having the first and second sets of tubes sloping downwardly from the first ends of the first and second sets of tubes to the second ends of the first and second sets of tubes away from the primary heat exchanger when the primary heat exchanger is disposed above the secondary heat exchanger.

In accordance with another aspect of the present invention, the foregoing advantages have been achieved through the present method for mounting a secondary heat exchanger in a furnace, having a primary heat exchanger, to permit the furnace to be installed for either an updraft or a downdraft mode of operation. This aspect of the present invention may comprise the steps of: hingedly mounting the secondary heat exchanger within the furnace, whereby the secondary heat exchanger may be disposed in an first position with the secondary heat exchanger sloping downwardly toward the primary heat exchanger for downdraft operation of the furnace, or the secondary heat exchanger may be disposed in a second position with the secondary heat exchanger sloping downwardly away from the primary heat exchanger for updraft operation of the furnace.

The high efficiency furnace method and apparatus of the present invention, when compared with previously proposed prior art high efficiency furnaces has the advantages of: permitting the same furnace to be installed for use in an upflow or downflow mode of operation; is easily, efficiently, and economically manufactured and assembled; and preventing moisture and combustion gas by-products, or condensation, remaining in the secondary heat exchanger and blocking passage of combustion gases therethrough and prevents condensation from flowing back into the primary heat exchanger.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims, and as discussed in this specification.

DETAILED DESCRIPTION OF THE INVENTION

Figure 1:
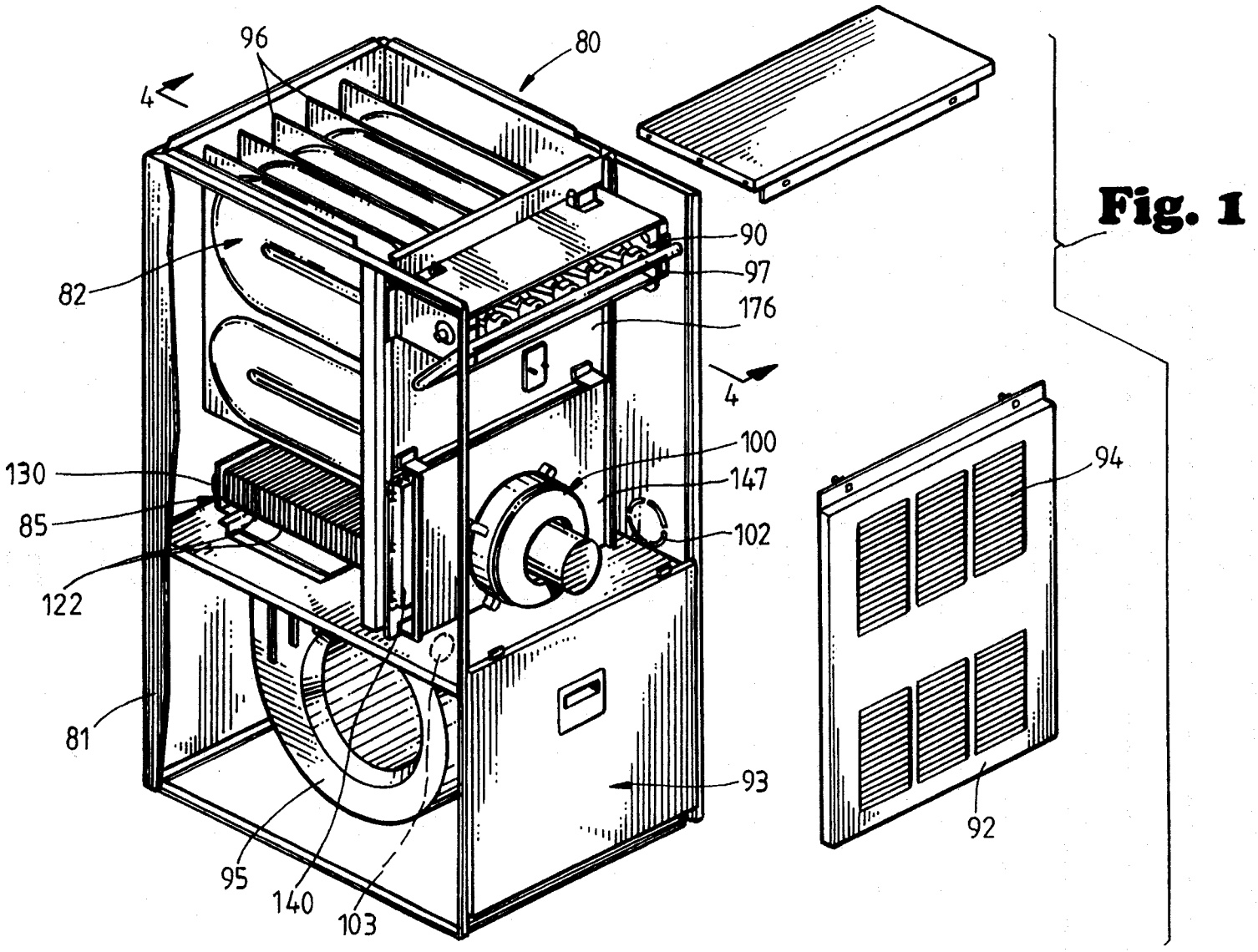
FIG. 1 is a partially exploded perspective view of a high efficiency furnace, installed in an updraft mode of operation, in accordance with the present invention.
Figure 2:
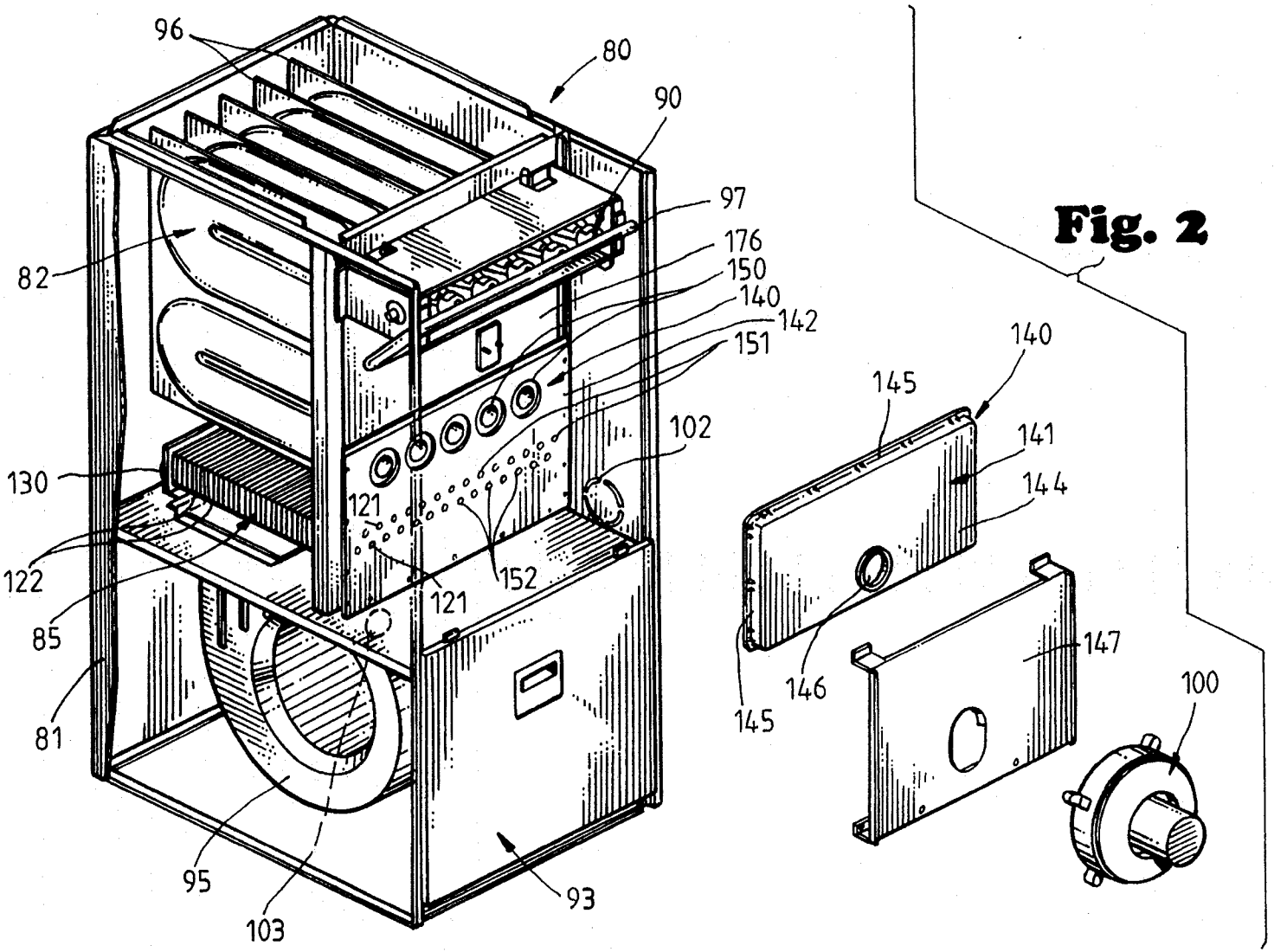
FIG. 2 is a partial exploded perspective view of the furnace of FIG. 1.
Figure 4:
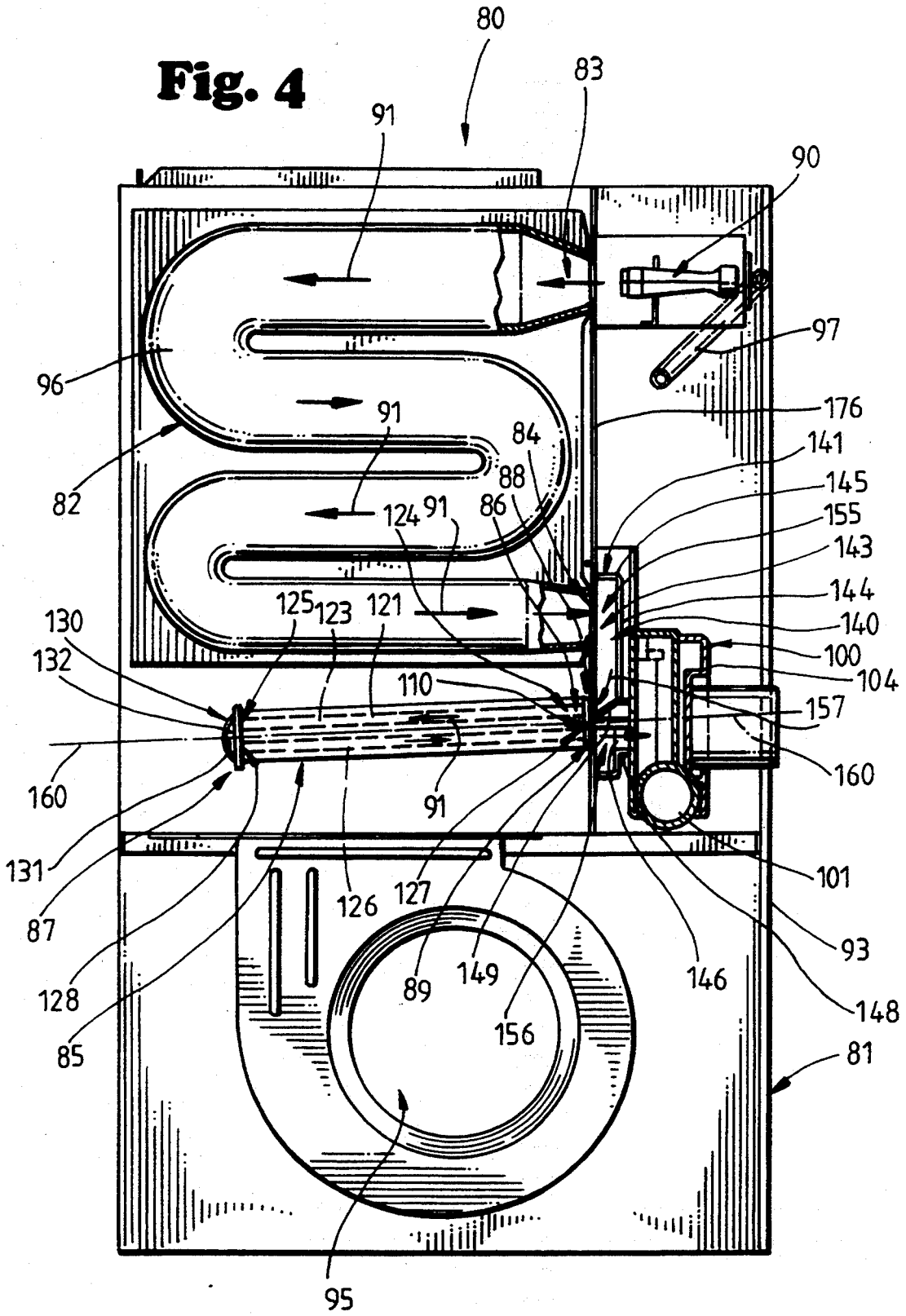
FIG. 4 is a partial cross-sectional view of the furnace taken along line 4—4 of FIG. 1.

In FIGS. 1, 2, and 4, a high efficiency furnace 80 in accordance with the present invention is shown to comprise a housing 81; a primary heat exchanger 82 having an inlet end 83 and outlet end 84; a secondary heat exchanger 85 having first and second ends 86, 87 and an inlet 88 and an outlet 89, the inlet 88 being disposed in fluid communication with the outlet end 84 of the primary heat exchanger 85; a burner assembly 90, for producing combustion gases (indicated by arrows 91), disposed adjacent the inlet end 83 of the primary heat exchanger 82, whereby the combustion gases may flow into the inlet end 83 of the primary heat exchanger 82; a blower 95, adapted to blow air over the primary and secondary heat exchangers 82, 85; a venter blower 100 in fluid communication with the outlet 89 of the secondary heat exchanger 85, and adapted to draw the combustion gases 91 through the primary and secondary heat exchangers 82, 85 and discharge the combustion gases outwardly from the housing 81; and means for mounting 110 (see also FIGS. 6 and 7) the secondary heat exchanger 85 within the housing 81 with both the inlet 88 and the outlet 89 of the secondary heat exchanger 85 being disposed adjacent the venter blower 100, the first end 86 of the secondary heat exchanger 85 being disposed adjacent the venter blower 100, with the secondary heat exchanger 85 sloping downwardly from its first end 86 toward its second end 87, whereby the cooling of the combustion gases in the secondary heat exchanger forming condensation (not shown), the condensation will initially flow downwardly within the secondary heat exchanger 85, as shown by arrow 91' from its first end 86 to its second end 87.

Figure 3:
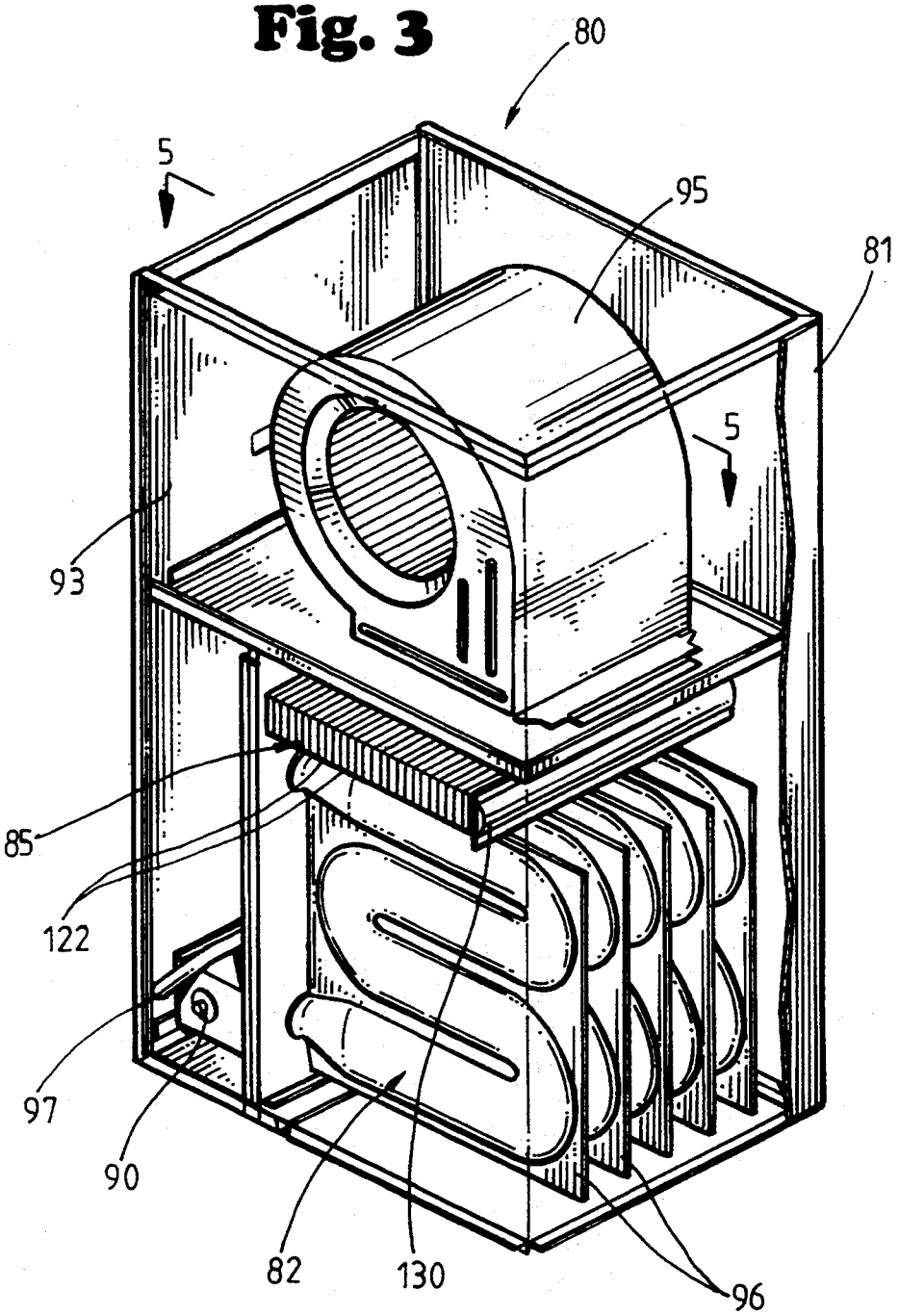
FIG. 3 is a perspective view of a high efficiency furnace, operating in a downflow mode of operation in accordance with the present invention.
Figure 5:
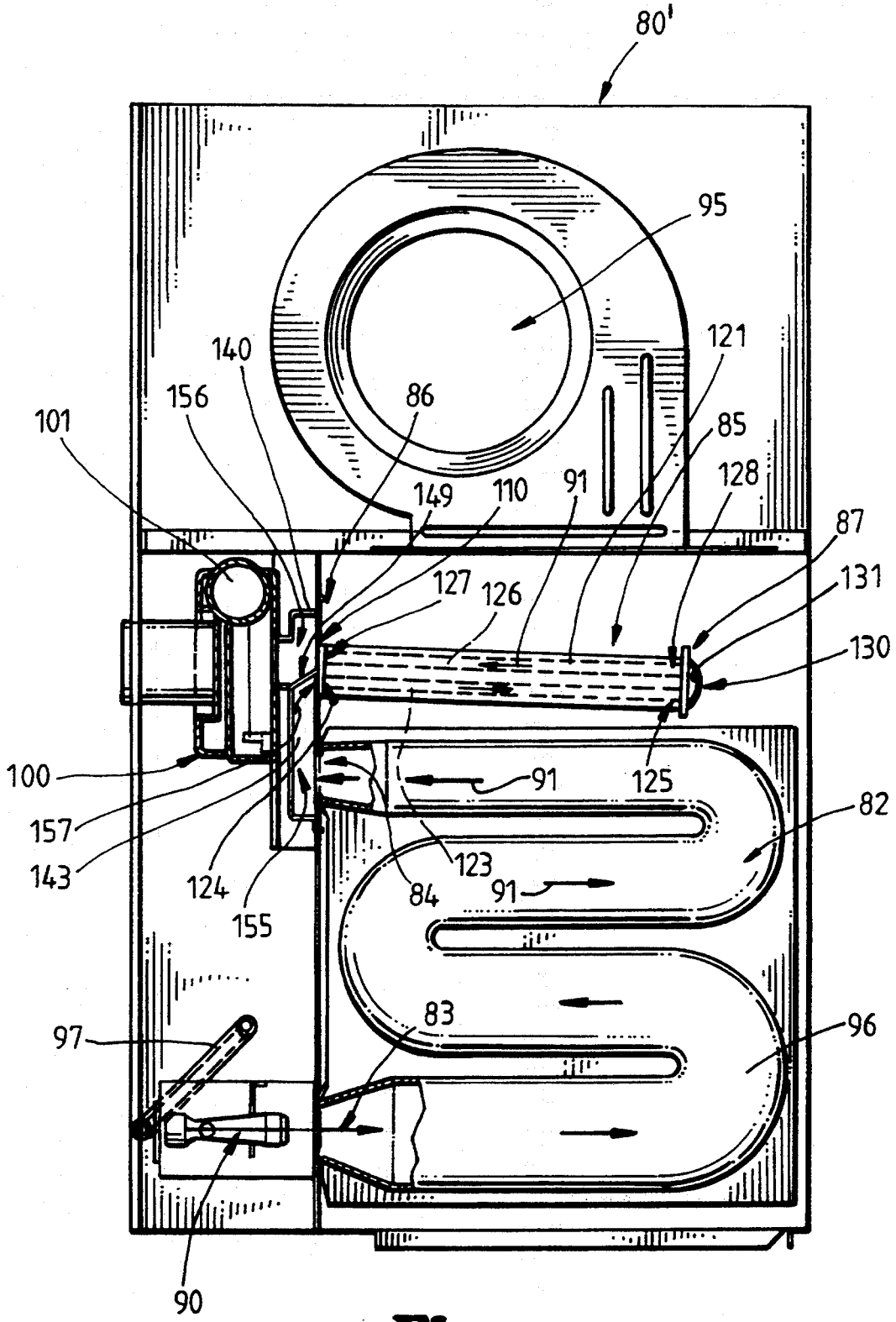
FIG. 5 is a partial cross-sectional view of the furnace taken along line 5—5 of FIG. 3.
Figure 6:
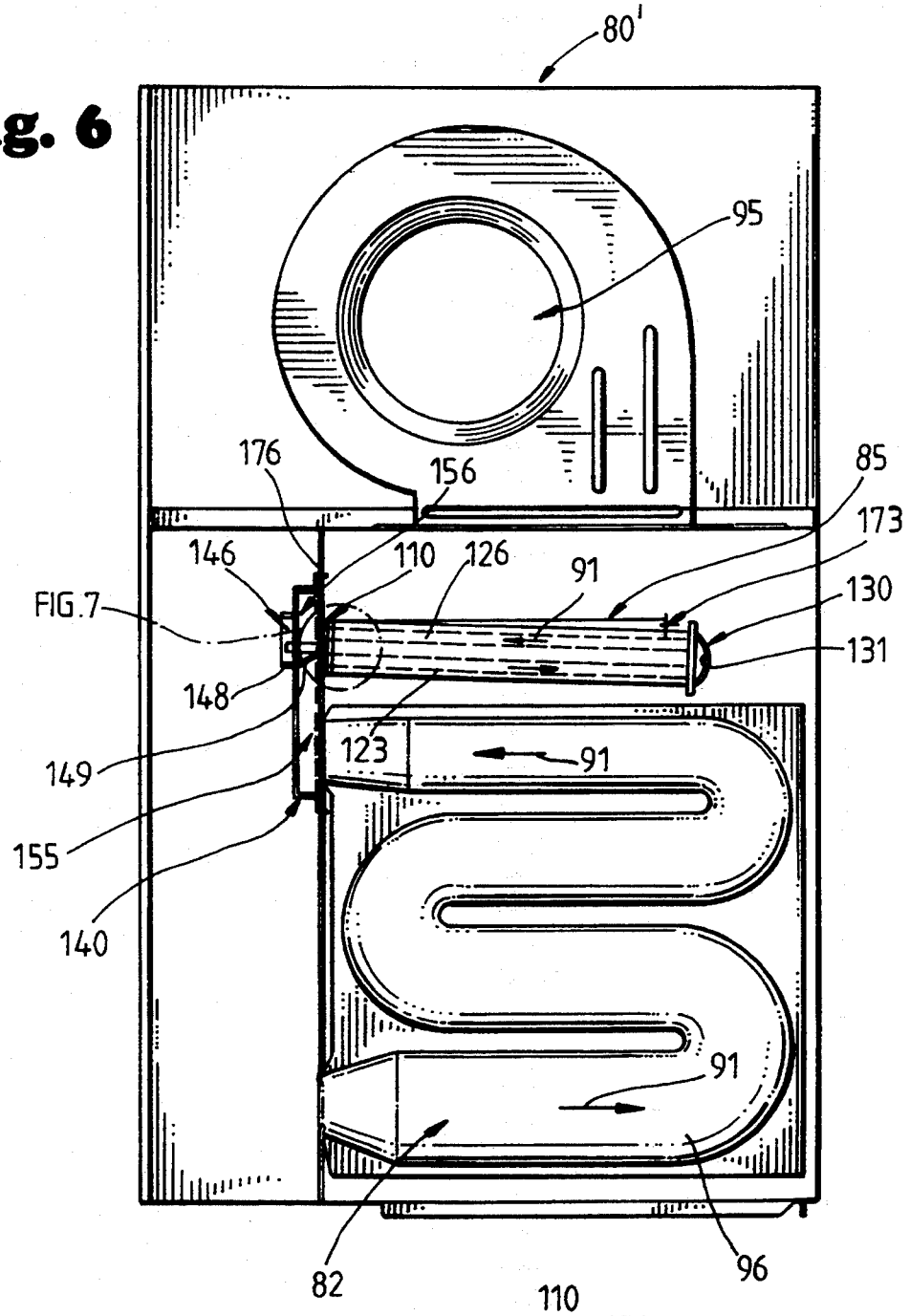
FIG. 6 is a partial cross-sectional view of the furnace taken along line 5—5 of FIG. 3.

It should be noted that the furnace 80 illustrated in FIGS. 1, 2, and 4 is illustrated as being installed for an upflow mode of operation, since blower 95 is disposed beneath the primary and secondary heat exchangers 82, 85 to blow air upwardly over the heat exchangers 82, 85. In FIGS. 3, 5, and 6, high efficiency furnace 80' is identical to high efficiency furnace 80, except that furnace 80' is illustrated for operation in a downflow mode of operation. Furnace 80' has blower 95 disposed above heat exchangers 82, 85, whereby air is blown downwardly over the heat exchangers 82, 85. The same reference numerals will be used throughout this specification to describe components which are identical in structure.

Still with reference to FIGS. 1, 2, and 4, housing 81 may be made in a conventional manner, and of conventional materials, such as sheet metal, and may include a room air inlet grill 92 which closes off the front 93 of housing 81 and covers burner assembly 90 and vent blower 100. Room air may pass through the grill portion 94 of room air inlet grill 92 to permit the combustion of natural gas which is fed into burner assembly 90, in a conventional manner. Cabinet 81 provides a vertical path for room air which is blown across the secondary heat exchanger 85 upwardly across and upon primary heat exchanger 82, whereby that air may be heated by the primary and secondary heat exchangers 82, 85 and be discharged through a conventional discharge plenum (not shown) disposed at the top of housing 81, and into the room, or space, desired to be heated, in a conventional manner.

Primary heat exchanger 82 may be of any construction, and preferably comprises a plurality of serpentine shaped clamshell heat exchanger units 96, which provide a surpentine path for the combustion gases 91 to pass from the inlet end 83 to the outlet end 84 of primary heat exchanger 82. Burner assembly 90 may be of conventional construction and design as is blower 95 and venter blower 100. A conventional gas manifold 97 provides the natural gas, or other fuel, to be burned by burner assembly 90.

As seen in FIG. 4, the secondary heat exchanger 85 slopes downwardly from its first end 86 toward its second end 87. Preferably, the angle of the tilt (See 173, FIG. 6) lies within a range of from ½ to 2 degrees; however, the angle of the slope of secondary heat exchanger 85 could be greater in order to compensate for an unlevel mounting surface for furnace 80, such as a floor which is not level, but tilted. Although it is believed that furnace 80 will operate without secondary heat exchanger 85 sloping downwardly, the slight amount of slope 173, FIG. 6, ensures that any moisture and/or combustion by-products, generally referred collectively as "condensation", formed by the cooling of combustion gases 91 in secondary heat exchanger 85, will be prevented from remaining within secondary heat exchanger 85, as will hereinafter be described in greater detail. For an upflow mode of operation for furnace 80, as shown in FIG. 4, secondary heat exchanger 85 slopes downwardly toward blower 95. As illustrated in FIG. 5, for furnace 80' operating in a downdraft mode of operation, secondary heat exchanger 85 slopes downwardly away from blower 95. Thus in both furnaces 80, 80', any condensation forming in secondary heat exchanger 85 will initially flow downwardly within the secondary heat exchanger 85 from its first end 86 to its second end 87.

Still with reference to FIGS. 1, 2, and 4, the secondary heat exchanger 85 is preferably a finned coil heat exchanger 120 having a plurality of tubes 121 supported by a plurality of transverse vertical fins 122. For drawing clarity, vertical fins 122 are not illustrated in FIGS. 4, 5, and 6. Finned coil heat exchanger 120 has a first set of tubes 123 having first and second ends 124, 125, the first ends 124 of the first set of tubes 123 being disposed in fluid communication with the outlet end 84 of the primary heat exchanger 82. Finned coil heat exchanger 120 also has a second set of tubes 126 having first and second ends 127,128, the first ends 127 of the second set of tubes 126 being disposed in fluid communication with the venter blower 100, as will be hereinafter described in greater detail. As seen in FIGS. 4 and 5, the first and second sets of tubes 123, 126, are disposed substantially parallel to each other. The second ends 125, 128 of the first and second sets of tubes 123, 126 are in fluid communication with each other at the second end 87 of the secondary heat exchanger 85. Preferably, the second end 87 of the secondary heat exchanger 85 is sealed by an end cap member 130 having an inner wall surface 131 which is curved, as shown in FIGS. 3–6. As will be hereinafter described in further detail, upon combustion gases 91 being drawn through secondary heat exchanger 85, through the action of vent blower 100, the combustion gases 91, and any condensation formed from the cooling of combustion gases 91 will flow downwardly through the first set of tubes 123 from their first ends 124 to the second ends 125. Upon the combustion gases 91 reaching the second end 87 of secondary heat exchanger 85, or the second end 125 of the first set of tubes 123, the combustion gases 91 and any condensation therein, will then enter the interior space 132 defined by the inner wall surface 131 of end cap member 130. The curved inner wall surface 131 will assist in directing the combustion gases 91 to enter the second end 128 of the second set of tubes 126, whereby the combustion gases 91 will then flow upwardly from the second ends 128 to the first ends 127 of the second set of tubes 126, and into the vent blower 100, which then vents the combustion gases 91 to a conventional flue (not shown) which passes upwardly and outside of the space or room to be heated. Vent blower 100 includes an exhaust passageway 101 (FIGS. 4 and 5) which can pass through an opening 102 formed in the right side of housing 81, or an opening 103 formed in the left side of housing 81, as shown in FIG. 1. Openings 102, 103 are connected to a conventional flue (not shown), as previously discussed. The outer housing 104 of vent blower 100 may be rotated to position exhaust 101 to line up either with opening 102 or opening 103 as desired by the installer of furnaces 80, 80'.

Still with reference to FIGS. 1, 2 and 4, the outlet end 84 of primary heat exchanger 82 is disposed in fluid communication with the inlet 88 of secondary heat exchanger 85 by a collector box, or manifold, 140. Collector box 140 also preferably places venter blower 100 in fluid communication with the outlet 89 of secondary heat exchanger 85. Collector box 140 is an enclosure formed of any suitable metal or temperature-resistant plastic material and is formed by a plurality of walls 141, 142 which define an interior space 143. Preferably, collector box is formed in two parts, wall 142 being basically a planar wall surface, and wall 141 being a substantially planar plate 144 with an upstanding ridge 145 disposed about wall 144. As seen in FIG. 2, an opening 146 is formed in one of the walls, such as wall 144, and opening 146 is in fluid communication with the venter blower 100, which is secured to an outer cover member 147 which overlies collector box 140. Venter blower 100 is secured to the outer cover member 147, and venter blower 100 includes a tubular connector 148 (FIG. 4) which mates with opening 146 of collector box 140.

As seen in FIG. 2, wall 142 of collector box 140 has a plurality of openings 150, 151, 152 formed therein for fluid communication with the primary and secondary heat exchangers 82, 85. A first set of openings 150 is in fluid communication with the outlet end 84 of primary heat exchanger 82, and the second and third sets of openings 151, 152 are in fluid communication with the secondary heat exchanger 85. As seen in FIGS. 4 and 5, collector box 140 has a diverter member, or diverter bar, 149 disposed within collector box 140, and the diverter member 149 separates the interior space 143 into first and second compartments 155, 156. The secondary heat exchanger 85 is seen to have a longitudinal axis 160, and the diverter member 149 is disposed within the collector box 140 at an acute angle 161 with respect to the longitudinal axis 160 of the secondary heat exchanger 85. The first compartment 155 is in fluid communication between the outlet end 84 of the primary heat exchanger 82 via the first set of openings 150, and secondary heat exchanger 85 via the second set of openings 151 which mate with the first ends 124 of the first set of tubes 123 of secondary heat exchanger 85. The second compartment 156 of collector box 140 is in fluid communication between the opening 146 and the secondary heat exchanger 85, via the third set of openings 152 in wall 142 which mate with the second ends 127 of the second set of tubes 126 of secondary heat exchanger 85.

As shown by arrow 157 in FIGS. 4 and 5, upon the combustion gases 91 exiting outlet end 84 of primary heat exchanger and passing into the first compartment 155 of collector box 140, the combustion gases are diverted, or directed, by diverter member 149 into the inlet 88 of secondary heat exchanger 85. By disposing diverter member 149 adjacent opening 146 of wall 144 of collector box 140, and disposing diverter member 149 to lie in a plane disposed between the second and third sets of openings 151, 152, upon combustion gases 91 exiting secondary heat exchanger 85 through outlet 89 and through openings 152, the combustion gases are likewise directed into venter blower 100. Although the combustion gases 91 and any condensation formed in secondary heat exchanger 85 must pass slightly upwardly through the second set of tubes 126, it has been found that the suction force produced by vent blower 100, along with the combustion gases 91, and any condensation, being deflected by the curved inner wall surface 131 of end cap member 130, upon exiting the second end 125 of the first set of tubes 123, is sufficient so that no appreciable condensation remains in the secondary heat exchanger 85. Accordingly, the first and second set of tubes 123,126 of secondary heat exchanger 85 do not become plugged with any condensation, which could have adverse effects upon the operation of furnace 80. Likewise, in connection with downdraft furnace 80' of FIG. 5, no condensation formed in secondary heat exchanger 85 has been found to flow out of secondary heat exchanger 85 and into the primary heat exchanger 82, which condensation could have an adverse effect upon the serpentine elements 96 of primary heat exchanger 82.

Figure 7:
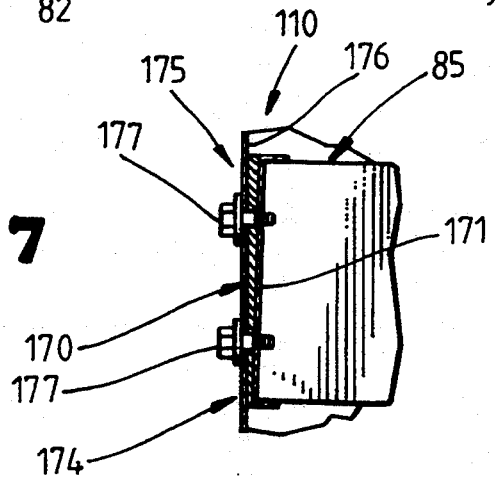
FIG. 7 is an exploded view of a means for mounting a secondary heat exchanger in accordance with the present invention.

With reference to FIGS. 6 and 7, the means for mounting 110 the secondary heat exchanger 85 within furnace 80' will be described. It should be noted that, as will be hereinafter described in greater detail, mounting means 110 is the same for both modes of operation of furnace 80, that is the updraft version 80 and the downdraft version 80'. Mounting means 110 permits secondary heat exchanger 85 to be disposed within the furnace 80, 80' in first and second sloping positions. The first sloping position is illustrated in FIG. 4, wherein the first and second sets of tubes 123,126 of secondary heat exchanger 85 slope downwardly from the first ends 124, 127 of the first and second sets of tubes 123, 126 to the second ends 125, 128 of the first and second sets of tubes 123, 126, and they slope toward the primary heat exchanger 82 when the primary heat exchanger 82 is disposed beneath the secondary heat exchanger 85, as illustrated in FIGS. 5 and 6. The second sloping position of secondary heat exchanger 85 is illustrated in FIG. 4, wherein the first and second sets of tubes 123, 126, slope downwardly from the first ends 124, 127 of the first and second sets of tubes 123, 126 toward the second ends 125, 128 of the first and second sets of tubes 123, 126, and they slope away from the primary heat exchanger 82, when the primary heat exchanger 82 is disposed above the secondary heat exchanger 85.

Still with reference to FIGS. 6 and 7, the means for mounting 110 the secondary heat exchanger 185 includes a hinge member 170 which permits the first and second sets of tubes 123, 126 to slope downwardly from their first ends 124, 127 toward their second ends 125, 128. Preferably, hinge member 170 is formed of a layer 171 of a flexible, compressible material disposed at the first ends 124, 127 of the first and second sets of tubes 123, 126. By utilizing a layer 171 of a flexible compressible material as hinge member 170, and since the secondary heat exchanger 85 is disposed within the furnace 80, 81 in a cantilever fashion as illustrated in FIGS. 4 and 6, the weight of the secondary heat exchanger 85 causes the desired angle of slope 173 of secondary heat exchanger 85 to be achieved. As seen in FIG. 7, the lower portion 174 of the layer 171 of flexible compressible material is compressed, and the upper end 175 has a greater thickness, or resiliently expands, to fill the space between secondary heat exchanger 85 and wall 176 (see also FIGS. 2 and 4) to which secondary heat exchanger 85 is secured by bolts 177. Preferably, the layer 171 of flexible, compressible material is neoprene, or any suitable resilient plastic material, such as silicone or polyurethane. It should be understood that any suitable plastic material could be utilized for the layer 171, provided it has the requisite heat resistance characteristics to be utilized in a furnace, as well as the ability to be flexible, compressible, and somewhat resilient, so that it can function in the manner illustrated in FIGS. 6 and 7. It should be noted that other hinge members 170 could be utilized to mount secondary heat exchanger 85 within furnaces 80, 80', such as a mechanical hinge which permits secondary heat exchanger 85 to slope in the desired direction, dependant upon whether or not the furnace is installed in an updraft mode of operation as illustrated in FIG. 4, or in a downdraft mode of operation as illustrated in FIG. 6.

By hingedly mounting the secondary heat exchanger 85 within the furnace 80, 80', the furnace of the present invention may be installed for either an updraft or downdraft mode of operation. The only modification of the furnace of the present invention which would be made by the individual installing the furnace would be to install a conventional pressure switch in the furnace 80, 80', so that it is located above the venter blower 100. Applicable American National Standards Institute safety standards require that all venter blowers in furnaces have such a pressure switch (not shown), which must be disposed above the venter blower. The conventional pressure switch turns off the gas supply to the furnace if there is a restriction in the exhaust 101 of venter blower 100, or if the venter blower fails. If the pressure switch is installed in furnace 80 of FIG. 1 above venter blower 100, on the assumption that the furnace 80 would be installed for an updraft mode of operation, and the installation requires that furnace 80 be installed for a downdraft mode of operation as illustrated in FIG. 6, the only modification to furnace 80 which would be made by the installer, would be to relocate the pressure switch to dispose it above venter blower 100.

It is to be understood that the invention is not limited to the exact details of construction, operation, exact materials or embodiment shown and described, as obvious modifications and equivalents will be apparent to one skilled in the art; for example, the primary heat exchanger could have some other form of construction, other than the serpentine shape illustrated herein. Accordingly, the invention is therefore to be limited only by the scope of the appended claims.

What is claimed is:

1. An upflow/downflow high efficiency furnace, comprising:

a housing;

a primary heat exchanger having an inlet end and an outlet end;

a secondary heat exchanger having first and second ends and an inlet and an outlet, the inlet being disposed in fluid communication with the outlet end of the primary heat exchanger;

a burner assembly, for producing combustion gases, disposed adjacent the inlet end of the primary heat exchanger, whereby the combustion gases may flow into the inlet end of the primary heat exchanger;

a blower, adapted to blow air over the primary and secondary heat exchangers;

a venter blower in fluid communication with the outlet of the secondary heat exchanger and adapted to draw the combustion gases through the primary and secondary exchangers and discharge the combustion gases outwardly from the housing; and means for mounting the secondary heat exchanger within the housing with both the inlet and the outlet of the secondary heat exchanger being disposed adjacent the venter blower, the first end of the secondary heat exchanger being disposed adjacent the venter blower, the means for mounting including a hinge member which permits the secondary heat exchanger to slope downwardly from its first end toward its second end, whereby upon the cooling of the combustion gases in the secondary heat exchanger forming condensation, the condensation will initially flow downwardly within the secondary heat exchanger from its first end to its second end.

2. The furnace of claim 1, wherein the secondary heat exchanger is a finned coil heat exchanger having a plurality of tubes supported by a plurality of transverse vertical fins.

3. The furnace of claim 2, wherein the finned coil heat exchanger has: a first set of tubes, having first and second ends, the first ends of the first set of tubes being disposed in fluid communication with the outlet end of the primary heat exchanger; and a second set of tubes, having first and second ends, the first ends of the second set of tubes being disposed in fluid communication with the venter blower.

4. The furnace of claim 3, wherein the first and second sets of tubes are disposed substantially to each other.

5. The furnace of claim 4, wherein the second ends of the first and second sets of tubes are in fluid communication with each other at the second end of the secondary heat exchanger.

6. The furnace of claim 5, wherein the second end of the secondary heat exchanger is sealed by an end cap member having an inner wall surface which is curved.

7. The furnace of claim 3, including a means for diverting the flow of combustion gases from the outlet end of the primary heat exchanger into the first set of tubes of the secondary heat exchanger.

8. The furnace of claim 7, wherein the means for diverting the flow of combustion gases includes a collector box which defines an enclosure, having an interior space, in fluid communication with the outlet end of the primary heat exchanger, the outlet and inlet of the secondary heat exchanger, and the venter blower.

9. The furnace of claim 8, wherein the collector box includes a diverter member which separates the interior space of the enclosure into first and second compartments, the first compartment being in fluid communication between the outlet end of the primary heat exchanger and the first set of tubes of the secondary heat exchanger, and the second compartment being in fluid communication between the venter blower and the second set of tubes of the secondary heat exchanger.

10. The furnace of claim 1, wherein the hinge member is formed of a layer of a flexible, compressible material disposed between the first end of the secondary heat exchanger and the venter blower.

11. The furnace of claim 10, wherein the flexible, compressible material is neoprene.

12. The furnace of claim 10, wherein the flexible, compressible material is a resilient plastic material.

13. A collector box, for use in a furnace having a primary heat exchanger, a secondary heat exchanger, a venter blower, and combustion gases flowing therethrough, comprising:

an enclosure formed by a plurality of walls and defining an interior space;

an opening in one of the walls adapted for fluid communication with the venter blower;

a diverter member disposed within the enclosure, the diverter member separating the interior space into first and second compartments, the first compartment being in fluid communication between the primary and secondary heat exchanger, and the second compartment being in fluid communication between the opening and the secondary heat exchanger; and the diverter member diverts the flow of combustion gases from the primary heat exchanger and the first compartment into the secondary heat exchanger and into the second compartment.

14. The collector box of claim 13, wherein the secondary heat exchanger has a longitudinal axis and the diverter member is disposed within the enclosure at an acute angle with respect to the longitudinal axis of the secondary heat exchanger.

15. The collector box of claim 14, wherein the diverter member is disposed within the enclosure adjacent the opening.

16. The collector box of claim 14, wherein one of the walls has a plurality of openings formed therein for fluid communication with the primary and secondary heat exchangers.

17. The collector box of claim 16, including a first set of openings for fluid communication with the primary heat exchanger, and second and third sets of openings for fluid communication with the secondary heat exchanger.

18. The collector box of claim 17, wherein the diverter member is disposed between the second and third sets of openings and the first compartment is in fluid communication with the first and second set of openings and the second compartment is in fluid communication with the opening and the third set of openings.

19. A finned coil secondary heat exchanger for use in a furnace having a primary heat exchanger and a venter blower with combustion gases flowing therethrough, comprising:

a first set of tubes, having first and second ends, the first ends of the first set of tubes adapted to be disposed in fluid communication with the primary heat exchanger;

a second set of tubes, having first and second ends, the first ends of the second set of tubes adapted to be disposed in fluid communication with the venter blower;

the first ends of the first set of tubes being disposed adjacent the first ends of the second set of tubes;

the first and second sets of tubes being disposed substantially parallel with each other; and means for mounting the secondary heat exchanger in the furnace in first and second sloping positions: the first sloping position, having the first and second sets of tubes sloping downwardly from the first ends of the first and second sets of tubes to the second ends of the first and second sets of tubes toward the primary heat exchanger when the primary heat exchanger is disposed beneath the secondary heat exchanger; and the second sloping position having the first and second sets of tubes sloping downwardly from the first ends of the first and second sets of tubes to the second ends of the first and second sets of tubes away from the primary heat exchanger when the primary heat exchanger is disposed above the secondary heat exchanger.

20. The secondary heat exchanger of claim 19 wherein the second ends of the first and second ends of the first and second sets of tubes are in fluid communication with each other.

21. The secondary heat exchanger of claim 20, wherein the second ends of the first and second sets of tubes are disposed in fluid communication with each other by an end cap member having an inner wall surface which is curved.

22. The secondary heat exchanger of claim 20, wherein the means for mounting the secondary heat exchanger includes a hinge member which permits the first and second sets of tubes to slope downwardly from their first ends toward their second ends.

23. The secondary heat exchanger of claim 22, wherein the hinge member is formed of a layer of a flexible, compressible material disposed at the first ends of the first and second sets of tubes.

24. The secondary heat exchanger of claim 23, wherein the flexible, compressible material is neoprene.

25. The secondary heat exchanger of claim 23, wherein the flexible, compressible material is a resilient plastic material.

26. A method for mounting a secondary heat exchanger in a furnace, having a primary heat exchanger, to permit the furnace to be installed for either an updraft or downdraft mode of operation, comprising the steps of:

hingedly mounting the secondary heat exchanger within the furnace, whereby the secondary heat exchanger may be disposed in a first position with the secondary heat exchanger sloping downwardly toward the primary heat exchanger for downdraft operation of the furnace, or the secondary heat exchanger may be disposed in a second position with the secondary heat exchanger sloping downwardly away from the primary heat exchanger for updraft operation of the furnace.

27. The method of claim 26, including the step of providing a fluid passageway in the secondary heat exchanger which passageway extends in two different directions through the secondary heat exchanger.

28. The method of claim 27, including the steps of:

utilizing a finned coil heat exchanger as the secondary heat exchanger, which includes a first set of tubes, having first and second ends, and a second set of tubes having first and second ends, with the first and second sets of tubes being disposed substantially parallel to each other; and disposing the second ends of the first and second set of tubes in fluid communication with each other with an end cap member having an inner wall surface which is curved.

29. The method of claim 26, including the step of hingedly mounting the secondary heat exchanger with a hinge member formed of a layer of a flexible compressible material.

30. The method of claim 29, including the step of utilizing neoprene as the flexible, compressible material.

31. The method of claim 29, including the step of utilizing a resilient plastic material as the flexible, compressible material.

* * * * *